US005308697A

United States Patent [19]

Muramoto et al.

[11] Patent Number: 5,308,697

[45] Date of Patent: May 3, 1994

[54] POTENTIALLY ELASTIC CONJUGATE FIBER, PRODUCTION THEREOF, AND PRODUCTION OF FIBROUS STRUCTURE WITH ELASTICITY IN EXPANSION AND CONTRACTION

[75] Inventors: Yasuo Muramoto, Hofu; Susumu Tokura, Shinnanyo; Kiyoshi Yoshimoto, Hofu; Hiroshi Naito, Yamaguchi; Yoshimichi Ozawa, Hofu; Tamotsu Matsutomi, Yamaguchi; Masami Fujimoto, Kudamatsu; Yoshiaki Morishige, Yamaguchi, all of Japan

[73] Assignee: Kanebo, Ltd., Tokyo, Japan

[21] Appl. No.: 962,230

[22] PCT Filed: May 14, 1992

[86] PCT No.: PCT/JP92/00624

§ 371 Date: Jan. 13, 1993

§ 102(e) Date: Jan. 13, 1993

[87] PCT Pub. No.: WO92/20844

PCT Pub. Date: Nov. 26, 1992

[30] Foreign Application Priority Data

May 14, 1991 [JP] Japan ..... 3-139769
Dec. 27, 1991 [JP] Japan ..... 3-360463

[51] Int. Cl.[5] ..... D02G 3/00; D02G 3/04

[52] U.S. Cl. ..... 428/373; 428/370; 428/374; 264/171

[58] Field of Search ..... 428/370, 373, 374; 264/171, 211.12

[56] References Cited

U.S. PATENT DOCUMENTS

| | | | |
|---|---|---|---|
| 3,639,556 | 2/1972 | Matsui et al. | 264/171 |
| 3,671,379 | 6/1972 | Evans et al. | 264/171 |
| 3,900,549 | 8/1975 | Yumane et al. | 264/171 |
| 3,987,141 | 10/1976 | Martin | 428/373 |
| 4,059,949 | 11/1977 | Lee | 428/373 |
| 4,557,972 | 12/1985 | Okamoto et al. | 264/171 |
| 4,707,398 | 11/1987 | Boggs | 428/373 |
| 5,162,153 | 11/1992 | Cook et al. | 428/374 |
| 5,164,262 | 11/1992 | Kobayashi et al. | 428/374 |
| 5,171,633 | 12/1992 | Muramoto et al. | 428/373 |

FOREIGN PATENT DOCUMENTS

| | | |
|---|---|---|
| 53-46931 | 12/1978 | Japan . |
| 58-46573 | 10/1983 | Japan . |
| 62-41316 | 2/1987 | Japan . |
| 62-28818 | 11/1987 | Japan . |
| 63-159523 | 7/1988 | Japan . |
| 646286 | 2/1989 | Japan . |

*Primary Examiner*—Patrick J. Ryan
*Assistant Examiner*—N. Edwards
*Attorney, Agent, or Firm*—Flynn, Thiel, Boutell & Tanis

[57] ABSTRACT

A potentially elastic composite filament, preferably a core-sheath composite filament composed of a polyurethane as the core and a polyester as the sheath, wherein the ratio of a polyurethane component having allophanate cross-linkages to a linear polyester component readily soluble in water or an aqueous alkali solution ranges from 1/1 to 90/1 and the polyester component is exposed on the surface of the filament in its cross-section. Although the core component has a high tensile strength and a large elongation at break, these properties are controlled by the sheath component. Therefore, this filament can be formed into a textile structure with good workability similar to that of ordinary synthetic fibers, and the obtained structure develops characteristics as an elastic polyurethane filament when treated with water or alkali.

11 Claims, 1 Drawing Sheet

POTENTIALLY ELASTIC CONJUGATE FIBER, PRODUCTION THEREOF, AND PRODUCTION OF FIBROUS STRUCTURE WITH ELASTICITY IN EXPANSION AND CONTRACTION

DESCRIPTION

1. Technical Field

The present invention relates to a composite filament having an excellent potentially elastic stretchability and recoverability, specifically a composite filament wherein a fiber-forming polymer having an excellent elastic stretchability and recoverability is conjugated with another fiber-forming polymer readily soluble in water or an aqueous alkali solution and less stretchable than the above polymer, so as to restrain a part of the elastic stretchability and recoverability of the former by the latter; a manufacturing process thereof; and a process for developing an excellent elastic stretchability and recoverability of textile structures comprising such a composite filament, for example, yarns, fabrics, secondary products thereof, or the like, by subjecting the textile structures to a treatment with water or an aqueous alkali solution. In this description and the appended claims, the term "readily soluble in water" should be understood to mean a quality of being substantially soluble in hot water and an aqueous alkali solution, and the term "readily soluble in an aqueous alkali solution" should be understood to mean a quality of being soluble in an aqueous alkali solution but being hardly or not soluble in hot water. Further, the term "water treatment" should be understood to include "an aqueous alkali solution treatment".

2. Background Art

Polyurethane elastomer yarns have been used in diversified fields in view of excellent physical properties thereof. However, due to their characteristics such as tackiness, high elongation, low modulus, or the like, these yarns have posed problems in abilities of being taken up during spinning and of yarn handling and operating in succeeding steps such as various yarn processings, knitting, weaving, and the like.

In order to decrease the tackiness, attempts have been made mainly by means of oiling agents. For example, oiling agents predominantly comprising dimethyl silicone admixed with a metallic soap or monoamines, and so forth, have been proposed in Japanese Patent Publication Nos. 5,557/65 and 16,312/71. Alternatively, as another method for preventing the tackiness, we, the present inventors, have proposed in Japanese Patent Publication No. 14,245/86 a manufacturing process of core and sheath type polyurethane based, elastic composite filaments comprising a urethane sheath and a crosslinked polyurethane core.

Further, as a different method for improving a yarn handling ability in succeeding steps, mention may be made of processes for decreasing elongation of polyurethane elastomer yarns, such as by covering with nylon yarns or the like, or hot or cold drawing. Furthermore, Japanese Patent Publication No. 8,606/80 discloses a composite filament having a potential rubber-like elasticity, composed of a water-soluble polyamide predominantly comprising a polybis(propoxy)ethaneadipamide conjugated with a polyurethane, which can develop its rubber-like elasticity by water treatment.

Among the above, an effect of improvement by means of oiling has been recognized to a certain extent but is limited and not perfect. Namely, suppose the case of spinning and taking-up on a take-up roll, if the tackiness of the yarns are reduced, the take-up operation tends to become impossible to continue for a long time due to cobwebbing, collapsing, etc. of the yarn package. This tendency becomes remarkable with increasing take-up speed (for example, to 500 m/min. or more) and with decreasing diameter of the yarn package (for example, to 100 mm or less) during taking-up. In contrast, if the yarns are made tacky, a long time take-up operation will be able to be conducted, whereas a serious trouble in succeeding steps will occur due to difficulties in yarn unwinding. Thus, only a delicate control of oiling agents does not necessarily cope with the difficulties.

Alternatively, in the case of elastic, urethane-urethane type core and sheath composite filaments, difficulties have been encountered in winding at a high speed on bobbins of a small diameter, in unwinding in the axial direction of yarn packages which has been usually performed with nylon yarns, polyester yarns or the like, and in yarn handling in succeeding steps.

On the other hand, the drawing process for decreasing the elongation of the polyurethane elastic yarns presents a problem such that special methods and apparatuses are required since yarn packages cannot be unwound in the axial direction with usual drawing machines. Alternatively, in the case of hot drawing, a contact process is liable to cause yarn breakages due to a high friction of polyurethane elastic yarns, so it raises a problem in operation and, therefore, a non-contact process is required. Further, in order to heat-set polyurethane elastic yarns, a considerably severe condition, such as a high temperature or high elongation, is required. Thus, physical properties of the polyurethane elastic yarns will have been deteriorated before the yarns proceed to the succeeding steps and there is a fear of impairing qualities of final products.

Processes for covering a polyurethane elastic yarn with a nylon yarn or the like require a special equipment and, further, pose a different problem of an extremely low output rate.

Furthermore, with respect to the elastic composite filaments comprising a water-soluble polyamide sheath component and a polyurethane core component, the yield is low in the synthesis of starting materials of this polyamide i.e. diamines having ether-linkages, and spinning is difficult due to low thermal and melt stabilities of the obtained polyamides, so that these filaments have never been commercialized.

Alternatively, it is the present situation that a production rate of polyurethane elastomer yarns is low as compared with general-purpose polymer yarns, such as nylon yarns, polyester yarns or the like. For example, the spinning rate of the polyurethanes in the case of melt-spinning is said to be limited in about 500 m/min. This is because, as described in the Journal of Textile Society in Japan, vol. 47, p. 581 (1991), taking-up of the spun filaments becomes difficult as liability of molecular orientation increases with increasing spinning rate, resulting in hardening of the spun filaments, and due to high elongation of the filaments. A breakthrough has never been made in achieving speedup to overcome the restriction of a low modulus inherent in polyurethane filaments.

In Japanese Patent Application Publication No. 6286/89, there has been proposed a composite filament comprising a copolyester soluble in hot water as one component which is readily convertible into an ultrafine filament yarn or a filament having a special, heterocross-sectional shape by removing the copolyester with hot water. However, the filaments obtained by the hot water treatment have too little elasticity to come under the concept of the potentially elastic filaments directed to by the present invention.

DISCLOSURE OF INVENTION

The present invention, therefore, is aimed to provide a novel potentially elastic composite filament yarn, which can be fabricated into textile structures, such as yarns, thread, fabrics, secondary textile products or the like, by handling in the same manner as general synthetic fibers, such as nylon or the like, and further can recover substantially completely properties as a polyurethane elastomer yarn through a water treatment or alkali treatment, such as scouring, dyeing or the like.

A further object of the present invention is to provide a process for manufacturing commercially advantageously at a low cost polyurethane elastomer filament yarns having a low modulus which can be taken up at the same take-up speed as general synthetic filament yarns, such as nylon yarns or the like.

The present inventors, as the result of assiduous studies to achieve the above objects, have accomplished the present invention.

Namely, the potentially elastic composite filament according to the present invention is characterized by a unitary filament comprising, as a polyurethane component, a crosslinked polyurethane having mainly an allophanate crosslinked structure, with a Shore A hardness of 75–98, and, as a polyester component, a polyester readily soluble in water or an aqueous alkali solution, bonded to each other at a polyurethane/polyester conjugate ratio (cross-sectional area ratio) ranging from 1/1 to 90/1, extending uniformly along the length of the filament, said polyester component being exposed on the surface of the filament and said polyurethane component alone being developable a tensile strength of 1.0–5.5 g/d, an elongation at break of 350–1,200% and an excellent elastic recoverability.

The conjugate shape of the above composite filament is most preferably of a core and sheath type composed of the polyurethane as the core component and the polyester as the sheath component.

The crosslink density of the above allophanate crosslinked structure is preferably at least 6 μmol/g, more preferably at least 10 μmol/g.

The above polyurethane/polyester conjugate ratio is preferably in the range of 1/1 to 50/1, more preferably in the range of 1/1 to 5/1. In general, a preferred value of the above tensile strength is in the range of 2.5 to 4.5 g/d and, however, when the conjugate ratio is in the range of 1/1 to 5/1, a tensile strength of the filament is preferred to be in the range of 1.8 to 5.5 g/d.

The above elongation at break is preferably 400–800%.

A preferred embodiment of the polyesters readily soluble in water is formed from, as an acid ingredient, 5–20 mol. % of an aromatic dicarboxylic acid and/or its ester-formable derivative (A ingredient), at least 55 mol. % of an aromatic dicarboxylic acid and/or its ester-formable derivative other than the A ingredient (B ingredient), an alicyclic dicarboxylic acid and/or its ester-formable derivative (C ingredient) and an aliphatic dicarboxylic acid and/or its ester-formable derivative (D ingredient) and, as a glycol ingredient, at least 50 mol. % of ethylene glycol, said C ingredient and D ingredient satisfying the following relation:

$$0 \text{ mol. } \% \leqq C+4D \leqq 40 \text{ mol.}$$

wherein C and D represent mol fractions of the C ingredient and D ingredient, respectively, in the total acid ingredient.

Further, as a preferred embodiment of the polyesters readily soluble in an aqueous alkali solution, mention may be made of copolyesters formed from terephthalic acid, isophthalic acid and a dicarboxylic acid having a sulfonate group as acid ingredients, and ethylene glycol as a diol ingredient.

The above polyesters readily soluble in water or an aqueous alkali solution preferably have a glass transition temperature of 35°–80° C.

The process for manufacturing potentially elastic composite filament yarns according to the present invention is characterized by melting separately a thermoplastic polyurethane having a Shore A hardness of 75 to 98 and a polyester readily soluble in water or an aqueous alkali solution, admixing the resulting polyurethane melt with a polyisocyanate, and then conjugate-spinning the both molten polymers at a polyurethane/polyester conjugate ratio by volume of 1/1 to 90/1 in such a relative arrangement in the cross-section of the filament that said polyester may be exposed on the surface of the filament, followed by taking up at a take-up speed of 300–3,000 m/min.

Further, the process for manufacturing textile structures having an elastic stretchability and recoverability according to the present invention is characterized by fabricating a textile structure with the above-described potentially elastic composite filament yarn and treating said textile structure with water or an aqueous alkali solution under heating to substantially dissolve and remove the aforesaid polyester.

BRIEF DESCRIPTION OF DRAWINGS

The present invention will be concretely explained in more detail hereinafter with reference to the appended drawings. In the drawings.

BEST MODE FOR CARRYING OUT THE INVENTION

Figure 1:
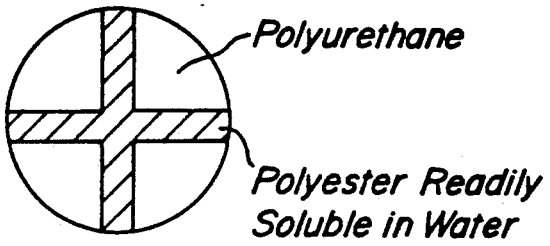
FIG. 1 is a cross-sectional view showing an example of a preferred conjugate shape of the composite filament according to the present invention.

The polyurethane constituting the filament of the present invention is meant by a crosslinked polyurethane derived from a thermoplastic polyurethane. The thermoplastic polyurethane is a melt-spinnable polymer obtained by reacting a high molecular diol with an organic diisocyanate and a chain extender.

As a high molecular diol, mention may be made of glycols, such as ether-based polyols, such as polytetramethylene glycol, polypropylene glycol or the like, and ester-based polyols, such as polyhexamethyleneadipate glycol, polybutyleneadipate glycol, polycarbonate diol, polycaprolactone diol or the like, having hydroxyl groups at both terminals and a molecular weight of 500–5,000, either alone or in combination.

As a chain extender, mention may be made of 1,4-butane diol, ethylene glycol, propylene glycol, bis-hydroxyethoxy-benzene and the like.

As an organic diisocyanate, mention may be made of tolylene diisocyanate (TDI), 4,4'-diphenylmethane diisocyanate (MDI) or a non-yellowing diisocyanate, such as 1,6-hexane diisocyanate or the like, and mixtures thereof.

In the present invention, thermoplastic polyurethanes polymerized from these ingredients in a process known per se, having a JIS-Shore A hardness in the range of 75 to 98, are applied. A hardness less than 75 tends to pose problems such that the obtained composite filaments have a poor elastic recoverability and an insufficient, practicable heat resistivity. Inversely, if the hardness exceeds 98, problems will be presented such that the polyurethane itself will exhibit such a poor elastic recoverability that elastic recoverability of the composite filament cannot be expected unless depending upon a crimped structure and, furthermore, that the optimal spinning conditions of such a polyurethane are limited in a narrow range. Preferably, the hardness is in the range of 82 to 95.

Polyurethanes to be applied to the present invention, if required, may be incorporated with a known additive, such as titanium dioxide, UV stabilizers, UV absorbers, unti-fungus agents or the like.

In order to provide polyurethane filaments with a further heat resistivity and a further elastic recoverability, use may be made of a crosslinked polyurethane having mainly an allophanate crosslinked structure, which is obtained by reacting a polyisocyanate with the abovementioned thermoplastic polyurethane. As a process for manufacturing the crosslinked polyurethane, the process that the present inventors proposed in Japanese Patent Application Publication No. 46573/83 may be employed, wherein a molten thermoplastic polyurethane is admixed with a polyisocyanate and allophanate crosslinkages are completed during or after spinning.

This polyisocyanate is a compound comprising a polyol ingredient and an isocyanate ingredient, having at least 2, preferably 2–3 isocyanate groups in its molecule. As a polyol ingredient, the above-described diols having a molecular weight of 500–4,000 to be employed in synthesis of polyurethanes and, besides, mixtures of a diol with a triol having an average functionality of 2–3, or synthetic polyols having a functionality of 2–3, may be suitably employed. On the other hand, as an isocyanate ingredient, the above-described diisocyanate to be used in synthesis of polyurethanes, organic diisocyanate trimers, reaction products of trimethylol propane with an organic diisocyanate, or isocyanates having a functionality ranging from 2 to 3, for example, carbodiimide-modified isocyanates, or the like, may be employed alone or in combination.

The reaction of the above both ingredients can be conducted according to any known processes and, however, the reaction is preferred to be conducted so as to yield an excess of isocyanate content. Needless to say, this content should be selected depending upon aimed physical properties, such as heat resistivity, recoverability or the like, and the species of the polyol to be used.

The amount of the polyisocyanate to be added, though it depends on the NCO content and species of the polyisocyanate to be used, is preferred generally to be in the range of 5 to 40% by weight based on the mixture of a polyurethane with this polyisocyanate. An amount of the added polyisocyanate in excess of 40% by weight is not preferred, because the spinning operation will be instabilized due to uneven mixing, or mechanical properties of the resulting yarns tend to become unsatisfactory. An amount of less than 5% by weight is also not preferred, because an expecting heat resistivity is hardly obtained. A preferable range is 10 to 30% by weight.

Thus, a crosslinked structure mainly comprising allophanate crosslinkages is formed in a polyurethane. In this instance, urea linkages included in the polymer will form biuret linkages to extremely deteriorate the spinnability, so that it is not preferred. Namely, the biuret crosslinkages have a rate of formation higher than the allophanate crosslinkages so that the viscosity of the melt system during spinning may be liable to increase too much to conduct a stabilized spinning operation.

A crosslink density in the crosslinked polyurethanes is preferred to be at least 6 μmol/g when it is determined after dissolving the polyester component readily soluble in water or an aqueous alkali solution, constituting the composite filament yarn. If it is less than 6 μmol/g, heat resistivity as a composite filament yarn, namely, a practicable heat resistivity is difficult to obtain. At least 10 μmol/g is more preferable. In this instance, according to the above process, a polyurethane component having a high crosslink density and thereby being insolubilized in any solvent is naturally considered to be produced. However, needless to say, such a system can suitably be employed insofar as it has a good spinnability. Additionally, determination of the crosslink density of crosslinked polyurethanes was conducted according to the following method:

After dissolving a polyester component in its solvent, 1 g of a polyurethane was stirred in a dimethylsulfoxide/methanol mixed solution at 23° C. for 12 hours and then dissolved in a dimethylsulfoxide solution containing about 200 μmol/g of n-butylamine at 23° C. over 24 hours. Then, the n-butylamine was back titrated by a 1/100–1/50N HCl-methanol solution using bromphenol blue as an indicator, to find the crosslink density.

On the other hand, the polyesters readily soluble in water to be used in the present invention are, for example, copolymers which are readily soluble in hot water at at least about 50° C. but very hardly soluble in or very hardly tackified with water at room temperature. Such copolymers preferably have a composition as follows: namely, a composition comprising, as an acid ingredient, terephthalic acid, isophthalic acid, a dicarboxylic acid having a sulfonate group and/or an ester-derivative thereof and an alicyclic dicarboxylic acid and, as a diol ingredient, ethylene glycol, neopentylene glycol, diethylene glycol or the like. In a preferable embodiment, as an aromatic dicarboxylic acid having a sulfonate group and/or its ester-formable derivative (A-ingredient), use may be made of those having an alkali metal sulfonate group, such as an alkali metal salt of, for example, 4-sulfoisophthalic acid, 5-sulfoisophthalic acid, sulfoterephthalic acid, 4-sulfophthalic acid, 4-sulfonaphthalene-2,7-dicarboxylic acid, 5-[sulfophenoxy]isophthalic acid, or the like, or ester-formable derivatives thereof. Among the above, 5-sulfoisophthalic acid sodium salt or its ester-formable derivatives are particularly preferred. The content of these dicarboxylic acids having a sulfonate group and/or ester-formable derivatives thereof is preferred to be in the range of 5 to 20 mol. %, more preferably, 6 to 12 mol. % based on the total dicarboxylic acid ingredients, from the standpoints of ready-solubility in water and resistivity to water. If this content is less than 5 mol. %, the ready-solubility in water decreases, while if it exceeds 20 mol. %, a trouble during polymerization, a poor operability during pelletizing and the like will be caused and thereby a handling ability, thermoplasticity or the like of the polymers may be negatively affected, so that either case is not preferred.

As aromatic dicarboxylic acids and/or ester-formable derivatives thereof other than the above A-ingredient (B-ingredient), terephthalic acid and/or its ester-formable derivatives (B1-ingredient) and isophthalic acid and/or its ester-formable derivatives (B2-ingredient) are preferred from the standpoints of availability of raw materials, industrializability and provision of good mechanical properties. Further, the content of the above B-ingredient is preferred to be at least 55 mol. % based on the total dicarboxylic acids. If it is less than 55 mol. %, physical properties, particularly hot melt stability and heat resistivity of the resulting polymers tend to be impaired, so that it is not preferred. Besides, the molar ratio of B1 ingredient to B2 ingredient is preferred to be in the range of 2/8 to 8/2, more preferably 3/7 to 7/3, from the standpoints of non-crystallizability and ready-solubility in water.

As an alicyclic dicarboxylic acid and/or its ester-formable derivatives (C-ingredient), use may be made of 1,4-cyclohexane dicarboxylic acid, 1,3-cyclohexane dicarboxylic acid, 1,2-cyclohexane dicarboxylic acid, 1,3-cyclopentane dicarboxylic acid, 4,4'-bicyclohexyl dicarboxylic acid and the like or ester-formable derivatives thereof. Additionally, linear aliphatic dicarboxylic acids or ester-formable derivatives thereof may be used in an amount of at most 10 mol. % based on the total dicarboxylic acid ingredients. As such a dicarboxylic acid ingredient, mention may be made of aliphatic dicarboxylic acids, such as adipic acid, pimelic acid, suberic acid, azelaic acid, sebacic acid or the like, or ester-formable derivatives thereof. If the above linear aliphatic dicarboxylic acid ingredient is too excessive, the resulting polymer pellets not only become blocking-prone but also have a poor water-resistivity, so that it is not preferred. Namely, in a preferable embodiment of the polyesters readily soluble in water, a linear aliphatic dicarboxylic acid and/or its ester-formable derivative (D-ingredient) and the above C-ingredient are desired to satisfy the relation:

$$0\ mol.\ \% \leqq C+4D \leqq 40\ mol.\ \%$$

wherein C and D represent mol fractions of C-ingredient and D-ingredient, respectively, based on the total acid ingredients, not only in order to prevent blocking of the resulting polymer pellets but also from the standpoint of water-resistividy. This is because, if the above relation is not satisfied in such a case or another where, for example, the D-ingredient content is 20 mol. % and the C-ingredient content is 0 mol. %, the resulting polymer will have a glass transition temperature of about room temperature, causing a poor handling property as well as a liability to deterioration of physical properties.

Additionally, in the present invention, as a dicarboxylic acid ingredient other than the above, an aromatic dicarboxylic acid or its ester-formable derivative may be used in an amount of at most 30 mol. % based on the total dicarboxylic acid ingredients. As these dicarboxylic acid ingredients, mention may be made of aromatic dicarboxylic acids such as phthalic acid, 2,5-dimethyl terephthalic acid, 2,6-naphthalene dicarboxylic acid, 1,4-naphthalene dicarboxylic acid, biphenyl dicarboxylic acid, or the like, or ester-formable derivatives thereof.

On the other hand, as a diol ingredient, ethylene glycol is employed in an amount of at least 50 mol. % based on the total glycol ingredients, from the standpoint of spinnability of the resulting copolyesters. Further, glycol ingredients other than ethylene glycol, such as, 1,4-butanediol, neopentylglycol, 1,4-cyclohexane dimethanol, diethylene glycol, triethylene glycol, polyethylene glycol or the like, may be used in such an amount as not to negatively affect the mechanical properties, hot melt stability or the like.

As a preferable embodiment of polyesters readily soluble in water thus obtained, mention may be made of copolyesters obtained by copolymerizing at least 4 acid ingredients of (A) 5–15 mol. %, based on the total dicarboxylic acid ingredients, of a dicarboxylic acid having a sulfonate group and/or its ester-formable derivative, (B) 55–80 mol. %, based on the total dicarboxylic acid ingredients, of a mixture of terephthalic acid and/or its ester-formable derivative (terephthalic acid ingredient) with isophthalic acid and/or its ester-formable derivative (isophthalic acid ingredient) at a molar ratio of 30/70–70/30, (C) 5–30 mol. %, based on the total dicarboxylic acid ingredients, of an alicyclic dicarboxylic acid and/or its ester-formable derivative, with a glycol ingredient.

The above polyesters to be used in the present invention are readily soluble in water. The term "readily soluble in water" referred to in the present invention is not to be precisely construed physicochemically but to include "substantially soluble and/or finely dispersible in water". For example, it includes such an instance where fibers, when soaked for 3 minutes in a hot water bath at 95° C. at a bath ratio of 100, are completely dissolved and dispersed therein.

As such a polyester readily soluble in water, those having a glass transition temperature in the rang of 35° to 110° C. are preferred. If the glass transition temperature is less than 35° C., the handling property of the obtained composite filament yarns tends to be impaired, so that it is not preferred. Contrarily, if it exceeds 110° C., solubility in water will become insufficient, so that it is not preferred, either. As far as it is within the above range, the polyester is readily soluble, for example, in hot water at at least 50° C. but very hardly soluble in or hardly tackified by water at less than 50° C., so that it has a good handling property. The glass transition temperature is determined with a thermoanalyser (the trademark, TAS 100, manufactured by RIGAKU K. K.) by elevating the temperature once up to 180° C. at a temperature increasing rate of 10° C./min. in a nitrogen gas stream, then cooling down to −150° C. and thereafter elevating the temperature again.

In order to provide copolyesters hardly soluble in water at at most 30° C., the glass transition temperature is an important factor and, for this purpose, the composition and its ingredient ratio are preferred to be determined so that the glass transition temperature may be a temperature of above 40°–60° C.

Further, as a polyester readily soluble in an aqueous alkali solution, mention may be made of copolyesters comprising terephthalic acid, isophthalic acid and a dicarboxylic acid having a sulfonate group, as a dicarboxylic acid ingredient, and ethylene glycol, as a diol ingredient. For example, it includes those obtained by copolymerizing a polymer comprising isophthalic acid/terephthalic acid/ethylene glycol with at least 2.5 mol. %, preferably at least 3.3 mol. %, of 5-sulfoisophthalic acid or its metal salt, or with at least 6% by weight of a polyethylene glycol.

The polyesters readily soluble in water or an aqueous alkali solution are preferred to be fiber-forming linear polymers and melt-spinnable, and desired to exhibit fluidity at a temperature ranging, for example, from 180° to 300° C. and be spinnable without foaming or decomposing. Though the copolyesters readily soluble in water to be applied to the present invention have excellent heat stability and stringiness, they may develop tackiness, if an aqueous spinning oil emulsion being used in usual melt-spinning processes is applied, causing an excessive rewinding tension during drawing, whereby drawing operability may be deteriorated, so that it is preferred to use non-aqueous spinning oils.

Additionally, into the polyesters readily soluble in water or an aqueous alkali solution, known additives, such as delustrants, anti-oxidants, lubricants or the like, may be incorporated.

As a polymerization process for producing the copolyesters to be used in the present invention, various usual processes can be utilized. Applicable processes are, for example, a process comprising the steps of conducting an ester-interchange reaction of a dicarboxylic acid dimethyl ester and a glycol, distilling off producing methanol, then vacuumizing gradually and conducting a polycondensation reaction under a high vacuum; a process comprising the steps of conducting an esterification reaction of a dicarboxylic acid and a glycol, distilling off producing water, then vacuumizing gradually and conducting a polycondensation reaction under a high vacuum; and in the case where a dicarboxylic acid dimethyl ester and a dicarboxylic acid are used in combination as starting acid ingredients, a process comprising the steps of conducting an ester-interchange reaction of the dicarboxylic acid dimethyl ester and a glycol, then adding the dicarboxylic acid, conducting an esterification reaction and then conducting a polycondensation reaction under high vacuum. As a reaction catalyst, any known catalysts can be employed, such as ester-interchange catalysts, for example, manganese acetate, calcium acetate, zinc acetate or the like, and such as polycondensation catalysts, for example, antimony trioxide, germanium oxide, dibutyltin oxide, titanium tetrabutoxide or the like. Further, as a stabilizer, use may be made of phosphorus compounds such as trimethyl phosphate, triphenyl phosphate or the like, and hindered phenolic compounds, such as IRGANOX 1010 TM, or the like. However, various conditions, such as polymerization processes, catalysts, stabilizer or the like, are not limited to the above-described examples.

Both the polyurethane and polyester components have been explained above, and in the next place, the conjugate ratio will be explained.

The conjugate ratio should be in the range of 1/1 to 90/1, preferably 1/1 to 50/1, more preferably 1/1 to 5/1, by volume, that is, by cross-sectional area of the filament.

More preferably, it may be in the range between 4/1 and 20/1. If the conjugate ratio is less than 1/1, the filament is liable to become so brittle that the handling ability will be low in succeeding steps, such as drawing and the like, and further the component to be dissolved off from the filament increases in amount, resulting in an economical disadvantage. Contrarily, if the conjugate ratio exceeds 90/1, spinnability tends to be lowered, and particularly in the case of a sheath and core type, the sheath component becomes liable to break, so that it is not preferable.

As the conjugate shape, two components may be conjugated into any shape, insofar as the above water-soluble polyester component is exposed on the surface of the filament in its cross-section. Any known shapes, such as a core and sheath type, cruciform type, or the like, may be extensively applied. Among these, a concentric core and sheath type conjugate shape wherein both the centers of gravity of the core and sheath components meet together is particularly preferred from the aspects of spinning stability as well as uniformity and handling property of the resulting filaments. Alternatively, a cruciform type as shown in FIG. 1 or the like are also preferred, because polyurethane ultrafine filament yarns which are difficult to manufacture by dry spinning or wet spinning can be readily obtained by dissolving and removing the polyester component. In this instance, yarns consisting of 2 or less denier per filament, for example, 0.2 denier per filament, can readily be obtained. Alternatively, the cross-sectional shape of the composite filament may be circular or non-circular.

A process for manufacturing the filament yarns according to the present invention, inter alia, core and sheath type composite filament yarns comprising a cross-linked polyurethane core, will be explained hereinafter.

Conjugate spinning can be suitably performed with a melt-conjugate-spinning apparatus provided with a spinning head including a means of admixing a polyisocyanate with a thermoplastic polyurethane before the polyurethane is melt-extruded, a means of melt-extruding a water- or alkali-readily-soluble polyester sheath component, and a known spinneret for core and sheath type conjugate spinning.

As the means of admixing a polyisocyanate with a molten thermoplastic polyurethane, a mixing apparatus provided with a rotating part can be used. However, what is more preferable is use of a mixing apparatus provided with static mixing elements known per se. The shape and number of the static mixing elements depend on use conditions and, however, they are important to be selected so that a thorough mixing may have been completed before the flow of the thermoplastic polyurethane admixed with polyisocyanate reaches the conjugate-spinning spinneret. Usually, 20–90 elements are provided. Thus, a core component of a molten polyurethane admixed with a polyisocyanate and a sheath component of a water-readily-soluble polyester melted separately by another extruder are introduced into a conjugate-spinning spinneret and spun out into a composite filament yarn which is taken up on a take-up roll.

Figure 2:
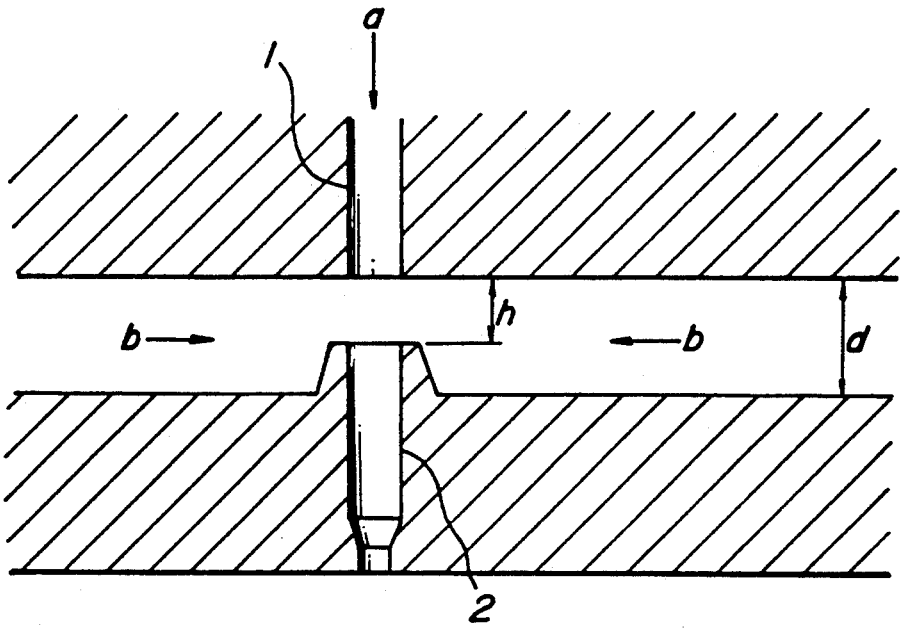
FIG. 2 is a vertical sectional view showing an example of a preferred core and sheath type spinneret for spinning the composite filament yarn according to the present invention.

Further, in designing a spinneret for conjugate spinning in a core and sheath type at a conjugate ratio of, for example, at least 15/1, the structure of the core and sheath components meeting portion in the spinneret is preferred to be formed as shown in FIG. 2, namely, a horizontal approach of a sheath component b is constructed to have a small depth d, for example, at most 2 mm. Further, it is preferred to devise to decrease a space h between the lower end of an upper vertical conduit 1 (inner orifice conduit) for introducing a core component a and the upper end of a lower vertical conduit 2 for spinning out a conjugated flow, for example, to 0.05–1.0 mm, near around a vertical conduit 2.

The yarn taking-up process is preferred to be conducted at a speed of at least about 300 m/min. and at most about 3,000 m/min. with a take-up machine operable at a speed as high as, for example, about 8,000 m/min. If ordinary polyurethane filament yarns are manufactured at such a high speed, elongation at break decreases and stress increases extremely. In contrast, according to the present invention, it is supposed that such disadvantages are hardly suffered even when the yarns are taken up at such a high speed, because the polyester component restrains the polyurethane component from elongation and molecular orientation is not effected.

As a measure for reducing elongation at the stage of raw yarns, use may be made of at least one of the two methods: one for reducing elongation of as-spun yarns by optimizing conditions at spinning step, such as a composition of polymers, conjugate ratio, spinning rate or the like; and the other by subjecting the as-spun yarns to a drawing step. Among the above, a process for setting a degree of elongation at the spinning step, particularly a spin-draw process, is preferred. Namely, by hot-drawing or cold-drawing a composite filament yarn at a draw ratio of 1.3–6.5 times by means of a draw roll during spinning, the polyester sheath component is readily oriented and set with the consequence that the core component is also set, so that the handling property of the yarn is very much improved. After the spinning step and/or drawing step, the final elongation at break of the composite filaments is preferred to be at least about 150%, particularly in the range of 20 to 100%. Alternatively, a tensile strength of at least 0.5 g/d is preferred from the standpoint of operability.

The filament yarns according to the present invention can be used as a continuous filament yarn, processed into cut staples or the like, or fabricated into various textile structures, such as web-like fabrics, textile secondary products or the like, by mix-knitting, mix-weaving or blending with other natural fibers or synthetic fibers, with a very good processability and without any special equipment being required. Particularly, the potentially elastic composite filament yarns according to the present invention can be cut into staples and blended with other fibers. Further, even when tricot is fabricated from polyurethane elastic filament yarns, since the elasticity of the polyurethane yarns of the invention is potential, it is not necessary to use sophisticated warpers which have been used exclusively for polyurethane elastic yarns. Instead, ordinary warpers to be used in processing ordinary yarns, such as nylon yarns, are applicable, which have so far been regarded as very difficult in processing conventional elastic yarns. Furthermore, there have never been in the past heat-resistant polyurethane elastic filament yarns as ultrafine as 0.2 d/f.

In manufacturing textile structures having elastic stretchability and recoverability according to the present invention, use may be made of a process wherein the filament yarns of the present invention is fabricated into thread, fabrics, such as woven or knitted fabrics, nonwoven fabrics or the like, or textile secondary products and then subjected to a water treatment to dissolve the sheath component to develop elasticity. The water treatment can be performed by utilizing a treatment with an aqueous solution in scouring, dyeing or the like steps. Particularly, in the case where the sheath component is readily soluble in an aqueous alkali solution, known processes of weight reduction with alkali which are generally used for polyester fibers also can be utilized. As explained above, since it comprises a water- or alkali-readily-soluble polyester sheath component and a polyurethane core component, the filament of the present invention has advantages as follows:

the sheath component polyester is produced readily by polymerization and has a good hot-melt stability;

stretchability of fabricated composite yarns can be controlled at discretion;

this filament has an excellent taking-up ability during spinning operation, and exhibits substantially no tackiness so that it can be unwound from a bobbin, in the axial direction thereof;

in oil-application at spinning and taking-up steps, a non-expensive emulsion oiling agent can be employed, so that the filament yarns can be wound at a high speed, such as 1,000 m/min., on a bobbin of a small diameter, and further, in a high speed spinning at a rate as high as 3,000 m/min., taking-up is possible to conduct;

polyurethane elastic filament yarns obtained after dissolving the polyester component surprisingly have a tensile strength as high as, for example, 4 g/d and an elongation at break as high as 300% or more, which has never been conceivable with respect to conventional polyurethane fibers, and thus that the polyurethane filament yarns obtained by dissolving and removing the polyester component from the composite filament yarns according to the present invention exhibit a high tensile strength is an unexpected, remarkable effect;

elastic stretch-recovery of this polyurethane elastic filament yarns is about 80–90% in the case of polyester based polyurethanes, and about 88–95% in the case of polyether based polyurethanes;

ultrafine filament yarns of about 0.2 d/f can be readily obtained, which have not so far been conceivable with respect to conventional urethane elastic yarns; and this filament has a meritorious feature such as an advantage from the standpoint of industrial production, because it is produced by melt-spinning process.

The filament yarns according to the present invention, since they have excellent features as mentioned above, can be adapted for diversified applications. For example, they can be fabricated into swimsuits with a simplified process and an excellent operability and further suitably used in socks, underwear, panty hoses or the like. Particularly, if ultrafine filament yarns are used in these applications, articles having such excellent softness and hand as hitherto not obtainable can be obtained.

EXAMPLE

The present invention will be explained more concretely by way of example hereinafter which, however, is not limitative.

EXAMPLE 1

Thermoplastic polyurethane

A thermoplastic polyurethane was synthesized according to a usual process with 3,500 parts by weight of a polytetramethylene glycol having a molecular weight of 1,000 and 1,220 parts by weight of p,p'-diphenylmethane diisocyanate, using 245 parts by weight of 1,4-bis(β-hydroxyethoxy)benzene as a chain extender. This polymer had a relative viscosity of 2.12, determined at 25° C. with respect to its dimethyl formamide solution having a concentration of 1 g/100 ml.

Polyisocyanate

TABLE 1

| Test No. | | | Example 1-1 | Example 1-2 | Comparative Example 1-1 | Comparative Example 1-2 | Comparative Example 1-3 | Comparative Example 1-4 |
|---|---|---|---|---|---|---|---|---|
| Co-monomer ingredient | Acid ingredient (mol. %) | Dimethyl terephthalate | 40 | 40 | 40 | 40 | 40 | 25 |
| | | Dimethyl isophthalate | 33 | 33 | 33 | 36 | 20 | 50 |
| | | Dimethyl Na-sulfoisophthalate | 7 | 7 | 7 | 4 | 25 | 10 |
| | | 1,4-cyclohexane dicarboxylic acid | 20 | 20 | — | 20 | 15 | 15 |
| | | Adipic acid | — | — | 20 | — | — | — |
| | Glycol ingredient (mol. %) | Ethylene glycol | 100 | 65 | 65 | 100 | 100 | — |
| | | Diethylene glycol | — | 35 | 35 | — | — | 100 |
| Assesment of polymer | | Glass transtion temperature (°C.) | 51 | 35 | 25 | 50 | 52 | 20 |
| | | Water-solubility | good | good | good | insoluble | good | good |
| Assessment of yarn | | Tackiness of yarn | ◎ | ◎ | X | — | X | — |
| | | Strength (handling ability) of yarn | ◎ | ◎ | — | — | X | — |

A viscous compound was obtained by reacting 850 parts by weight of a polytetramethylene glycol having a molecular weight of 850 with 500 parts by weight of p,p'-diphenylmethane diisocyanate. This compound contained 6.2% by weight of NCO group.

Water-soluble copolyester 38.74 parts by weight of dimethyl terephthalate, 31.95 parts by weight of dimethyl isophthalate, 10.34 parts by weight of dimethyl 5-sodium-sulfoisophthalate, 54.48 parts by weight of ethylene glycol, 0.073 part by weight of calcium acetate monohydrate and 0.024 part by weight of manganese acetate tetrahydrate were subjected to an ester interchange reaction at 170°-220° C. under a nitrogen gas stream while distilling off methanol, then 0.05 part by weight of trimethyl phosphate, 0.04 part by weight of antimony trioxide as a polycondensation catalyst, and 17.17 parts by weight of 1,4-cyclohexane dicarboxylic acid were added and esterification was conducted at a reaction temperature of 220°-235° C. while distilling off about a theoretical amount of water. Thereafter, the reaction system was further vacuumized and heated, and finally a polycondensation reaction was conducted at 280° C. at 0.2 mmHg for 2 hours. Then, compositions having formulation as shown in Table 1 were polymerized in the same manner as the above.

Assessment of the obtained polymers was conducted according to the following methods:

glass transition temperature: determination was conducted with a thermoanalyser (the trademark, TAS 100, manufactured by RIGAKU K. K.) by elevating the temperature once up to 180° C. at a temperature increasing rate of 10° C./min. in a nitrogen gas stream, then cooling down to −150° C. and thereafter elevating the temperature again; and water-solubility: assessment was conducted of 75 g of a copolyester added with 425 g water which was agitated at 95° C. for 3 hours.

These polymers were spun individually into a single component filament yarn from an orifice of a 0.5 mm diameter at an orifice temperature of 230° C., applied with a oiling agent mainly comprising dimethyl silicone and then taken up at a take-up rate of 500 m/min. Thus, 40 denier monofilament yarns were collected. The results are shown in Table 1.

In Table 1, the yarn of the polymer from Comparative Example 1—1 was not measured for its tensile strength and elongation at break, because this polymer had a poor handling property in dry and, moreover, the yarn obtained therefrom exhibited an increased tackiness. The polymer of Comparative Example 1-2 contained less than 5 mol. % of a dimethyl 5-sodium-sulfoisophthalate moiety and was water-insoluble. The yarn from Comparative Example 1-3 was very brittle and had a low handling ability. In Comparative Example 1-4, since only diethylene glycol was used as a diol ingredient, the polymer had a glass transition temperature close to room temperature. Further, since it was very difficult to dry and had a low handling ability, spinning was not conducted.

Then, examples of composite filament yarns will be explained.

The above-described thermoplastic polyurethane was melted in an extruder, 15% by weight of the above-described polyisocyanate was added to midway of the melt flow and then the combined flow was thoroughly mixed by a static mixer equipped with 35 mixing elements (manufactured by Kenics). On the other hand, the water-soluble polyester of Example 1—1 was melted in a separate extruder. The above two melts were separately metered and introduced into a spinneret for concentric type conjugate-spinning, having four orifices of a 0.5 mm diameter. A 40 denier monofilament yarn was collected at a take-up speed of 1,500 m/min. on a take-up roll. Alternatively, a filament yarn of 40 d/2 f was obtained according to a spin-draw process wherein the first godet roll of the take-up machine is set at a delivery speed of 500 m/min. and the delivery speed of the second godet roll for drawing (draw roll) was varied over 2-3 times that of the first godet roll. Other than the above, a polyurethane elastic yarn of 40 d/1 f without sheath component was spun (Comparative Example 1-7).

In the above spinning step, an oiling agent mainly comprising dimethyl silicone was used.

These results are shown in Table 2. Additionally, the yarns of Examples 1-5 ~ 1-7 and Comparative Example 1-6 were not subjected to drawing.

TABLE 2

| Test No. | | Example 1-3 | Example 1-4 | Comparative Example 1-5 | Comparative Example 1-6 | Example 1-5 | Example 1-6 | Example 1-7 |
|---|---|---|---|---|---|---|---|---|
| Core/sheath conjugate ratio (by cross-sectional area) | | 2/1 | 5/1 | 1/6 | 15/1 | 2/1 | 2/1 | 2/1 |
| Spinning step | Spinning process | Conventional take-up process | Conventional take-up process | Conventional take-up process | Conventional take-up process | Spin-draw process | Spin-draw process | Spin-draw process |
| | Draw ratio | — | — | — | — | 2 | 2 | 3 |
| | Temperature (°C.) | — | — | — | — | 25 | 60 | 25 |
| | Tensile strength (g/d) | 0.5 | 0.9 | 0.06 | 1.1 | 1.0 | 1.1 | 1.0 |
| | Elongation at break (%) | 120 | 240 | 12 | 502 | 85 | 32 | 45 |
| Drawing step | Draw ratio | 4.5 | 4.9 | not drawable | | No drawing conducted | | |
| | Temperature (°C.) | 160 | 180 | — | | | | |
| | Tensile strength (g/d) | 0.9 | 1.0 | — | | | | |
| | Elongation at break (%) | 35 | 46 | — | | | | |

As shown in Table 2, in the case where an ordinary take-up machine was used, the tensile strength was decreased with decreasing core/sheath conjugate ratio, and particularly when the conjugate ratio was 1/6, the strength was so extremely low as 0.06 g/d that it was difficult to subject the yarn to the drawing step, due to yarn breakages to occur. On the other hand, with respect to the yarns obtained by the spin-draw process, the elongation at break was decreased with increasing draw ratio during spinning, to an elongation substantially the same as ordinary yarns such as nylon. In the case of the conjugate ratio being 2/1, comparison of the yarns obtained by the ordinary take-up machine with those by the spin-draw process verifies that the latter is superior with respect to the strength as well as elongation. Further, the yarns of the examples of the invention were superior in the long time take-up ability, unwinding ability and unwinding-in-axial-direction ability.

The yarn of Example 1–7 was warped with an ordinary warper to be used in manufacturing nylon tricot. Further, using 50 d/12 f nylon yarns as front yarns and the warped yarns of the present invention as back yarns, knitting was conducted. The knitted goods were further processed in a finishing step with no problems.

EXAMPLE 2

Then, the yarns of Examples 1–4 and 1–7 and Comparative Example 1–7 were loaded with a weight of 1 mg/d and treated with hot water at 100° C. for 30 minutes, followed by air drying (Examples 2-1 and 2—2, and Comparative Example 2-1). The hot water shrinkability (hereinafter referred to as "HS") and physical properties after the hot water treatment of these yarns are shown in Table 3. The sheath component of the yarn of Example 1–7 had been completely dissolved after the hot water treatment. The HS was found by the following formula:

TABLE 3

| Test No. | Example 2-1 | Example 2-2 | Comparative Example 2-1 |
|---|---|---|---|
| HS (%) | 28.5 | 42.3 | 7.3 |
| Tensile strength (g/d) | 2.0 | 4.3 | 1.4 |
| Elongation at break (%) | 463 | 416 | 583 |

HS (%) = (original length − length after air dry) × 100/original length

As shown in Table 3, that the yarns of the present invention had a very high tensile strength as compared with that of an ordinary polyurethane elastic yarn being 1.4 g/d had never been expected and was surprising indeed. Further, with respect to drawn polyurethane elastic yarns, a so-called "spontaneous shrinkage" usually occurs and the yarns have shrunk before the determination of the HS is completed, and, however, no such a phenomenon was observed in the yarns of the examples, since they had been set. The yarns of the examples were further drawn at 150° C. 2 times their original length. In this case, the yarns exhibited such a high HS as 70%.

EXAMPLE 3

The water-soluble polyester used in Example 1 and the crosslinked polyurethane described in Example 1 were conjugate-spun into a composite filament yarn having a cruciform cross-sectional shape at a conjugate ratio of ½ as shown in FIG. 1. In this case, the spinning operation was also conducted according to a spin-draw process at a draw ratio of 2.5 times with the same apparatus as Example 1, and a filament yarn of 40 d/20 f was obtained. The results are shown in Table 4.

TABLE 4

| | Original yarn | | | Yarn after heat-shrinking | |
|---|---|---|---|---|---|
| Test No. | Tensile strength (g/d) | Elongation at break (%) | HS (%) | Tensile strength (g/d) | Elongation at break (%) |
| Example 3 | 0.92 | 15 | 40 | 1.9 | 573 |

It is understood from Table 4 that the potentially elastic yarn according to the present invention has a low elongation and compares favorably with nylon yarns or the like. Further, an ultrafine filament yarn of 1.3 d/f was readily obtained from the yarn of this example. This yarn was drawn 30% at room temperature and then heat-treated for 1 minute in a hot-flue at 190° C. Then, after restoring the room temperature, the yarn was relaxed and its stretch recovery was calculated by the following formula:

$$\textit{Stretch recovery}\ (\%) = (1.3 \times \textit{original length} - \textit{set length}) \times 100/(1.3 \times \textit{original length} - \textit{original length})$$

The result showed that without breaking by melting, the yarn exhibited a stretch recovery of 23% and had a sufficient heat resistivity. This yarn was useful for applications in not only textile field but also medical field, such as artificial veins or the like.

EXAMPLE 4

Spinning was conducted in the same manner as Examples 1 ~ 3 except that the core/sheath conjugate ratio was changed to 8/1, the polyurethane core component and the water-soluble polyester sheath component were arranged in a concentric relation, and using an ordinary take-up machine, the take-up speed was changed. For comparison, a single component filament yarn of a polyurethane incorporated with a polyisocyanate was also produced. The fineness of these yarns was 40 d/1 f. The results are shown in Table 5.

TABLE 5

| Test No. | Example 4-1 | Example 4-2 | Example 4-3 | Comparative Example 4-1 | Comparative Example 4-2 |
|---|---|---|---|---|---|
| Core/sheath conjugate ratio | 8/1 | 8/1 | 8/1 | Single component | Single component |
| Spinning rate (m/min.) | 500 | 1,000 | 3,000 | 500 | 1,000 |
| Tensile strength (g/d) | 0.78 | 1.05 | 1.21 | 1.58 | 1.62 |
| Elongation at break (%) | 781 | 723 | 699 | 540 | 355 |
| Stress at 300% elongation (g/d) | 0.11 | 0.12 | 0.15 | 0.45 | 1.23 |
| Stress at 100% elongation (g/d) | 0.02 | 0.03 | 0.05 | 0.12 | 0.45 |
| HS (%) | 0.0 | 0.5 | 2.1 | 6.8 | 13.6 |

It is understood from Table 5 that though the strength increases and the elongation decreases with increasing spinning rate, the yarns of the invention, as compared with the yarn of the comparative examples, is very soft, exhibiting surprisingly a high elongation and a low HS. On the other hand, it is understood that in the case of Comparative Example 4-2 where a single component yarn is spun at a high spinning rate, the resulting yarn becomes very hard.

EXAMPLE 5

Thermoplastic Polyurethane

A thermoplastic polyurethane was synthesized according to a usual process with 14.6 mol. % of a polyhexamethylene adipate having a molecular weight of 1,950 and 50.5 mol. % of p,p'-diphenylmethane diisocyanate, using 34.9 mol. % of 1,4-butanediol as a chain extender. This polymer had a relative viscosity of 2.15, determined at 25° C. with respect to its dimethyl formamide solution having a concentration of 1 g/100 ml.

Polyisocyanate

A viscous compound was obtained by reacting 23.9 mol. % of a polycaprolactone diol having a molecular weight of 1,250 and a functionality of 2.0 and 4.2 mol. % of a polycaprolactone triol having a molecular weight of 1,250 and a functionality of 3 with 71.9 mol. % of p,p'-diphenylmethane diisocyanate. This compound contained 6.6% by weight of NCO group.

Water-soluble copolyester 38.74 parts by weight of dimethyl terephthalate, 31.95 parts by weight of dimethyl isophthalate, 10.34 parts by weight of dimethyl 5-sodium-sulfoisophthalate, 54.48 parts by weight of ethylene glycol, 0.073 part by weight of calcium acetate monohydrate and 0.024 part by weight of manganese acetate tetrahydrate were subjected to an ester interchange reaction under a nitrogen gas stream while distilling off methanol at 170°–220° C., then 0.05 part by weight of trimethyl phosphate, 0.04 part by weight of antimony trioxide as a polycondensation catalyst, and 17.17 parts by weight of 1,4-cyclohexane dicarboxylic acid were added and esterification was conducted at a reaction temperature of 220°–235° C. while distilling off about a theoretical amount of water. Thereafter, the reaction system was further vacuumized and heated, and finally a polycondensation reaction was conducted at 280° C. at 0.2 mmHg for 2 hours. The obtained copolymer was analyzed and found to have an intrinsic viscosity of 0.45.

The above-described thermoplastic polyurethane was melted in an extruder, 18% by weight of the above-described polyisocyanate was added to midway of the melt flow and then the combined flow was thoroughly mixed by a static mixer equipped with 35 mixing elements (manufactured by Kenics). On the other hand, the above-described polyester was melted in a separate extruder. The above two melts were separately metered and introduced into a spinneret for concentric type conjugate-spinning, having 8 orifices of a 0.5 mm diameter. A 40 denier monofilament yarn was collected at a take-up speed of 600 m/min. on a take-up roll. Alternatively, using the above polyurethane without adding the polyisocyanate, the same conjugate-spinning was conducted. In this case, a 15% oil aqueous emulsion was used as a spinning oiling agent. On the other hand, the same conjugate-spinning as above was conducted, except that the sheath polyester component was replaced by a thermoplastic polyurethane. In this case, oiling agents comprising mainly dimethyl silicone and 5% and 0.2% by weight, respectively, of an amino-modified silicone as an isocyanate group inactivator were used (Comparative Examples 5-1 and 5-2).

The results are shown in Table 6.

TABLE 6

| Test No. | Example 5-1 | Example 5-2 | Comparative Example 5-1 | Comparative Example 5-2 |
|---|---|---|---|---|
| Sheath component | Water-soluble polyester | Water-soluble polyester | Thermoplastic polyurethane | Thermoplastic polyurethane |
| Core component (crosslink density) | Polyurethane (6) | Crosslinked polyurethane (30) | Crosslinked polyurethane (30) | Crosslinked polyurethane (30) |
| Core/sheath conjugate ratio | 10/1 | 10/1 | 10/1 | 10/1 |
| Tensile strength (g/d) | 0.89 | 1.13 | 1.59 | 1.59 |
| Elongation | 115 | 153 | 552 | 552 |

TABLE 6-continued

| Test No. | Example 5-1 | Example 5-2 | Comparative Example 5-1 | Comparative Example 5-2 |
|---|---|---|---|---|
| at break (%) | | | | |
| Unwinding coefficient | 1.00 | 1.00 | 1.00 | 1.00 |
| Long time taking-up ability | At least 5 hrs. | At least 5 hrs. | 30 min. | At least 5 hrs. |
| Axial unwindability | ◎ | ◎ | X | X |

In Table 6, the unwinding coefficient, when a filament yarn wound on a bobbin is unwound at a rate of 50 m/min. and taken up on a take-up roll, is represented by a surface speed ratio of the bobbin to the yarn package on the take-up roll, at the time when the unwinding of the yarn becomes impossible due to sticking to the surface of the bobbin. The long time taking-up ability is represented by a take-up continuable time, that is, a period of time during which a filament yarn can be taken up at a take-up rate of 600 m/min. on a paper tube having an outside diameter of 85 mm, without cobwebbing or collapsing of the yarn package occurring.

From Table 6, it is found that the filament yarns according to the present invention have excellent long time taking-up ability and ability of unwinding to the axial direction of bobbin (axial unwindability) and, on the other hand, with regard to the polyurethane/polyurethane composite elastic filament yarns, one having a tackiness has a high, long time taking-up ability but a low unwindability in contrast with that the yarn of Comparative Example 5-1 having no tackiness has an improved unwindability but is impossible to take up continually for a long time. The above yarn of Comparative Example 5-2 could not be used in succeeding steps unless measures, such as rewinding or the like, were taken.

EXAMPLE 6

The core/sheath conjugate ratio was changed. The results are shown in Table 7.

TABLE 7

| Test No. | Comparative Example 6-1 | Example 6-1 | Example 6-2 | Comparative Example 6-2 |
|---|---|---|---|---|
| Sheath componenet | Water-soluble polyester | Water-soluble polyester | Water-soluble polyester | Water-soluble polyester |
| Core component | Crosslinked polyurethane | Crosslinked polyurethane | Crosslinked polyurethane | Crosslinked polyurethane |
| Core/sheate conjugate ratio | ½ | 5/1 | 40/1 | 100/1 |
| Tensile strength (g/d) | 0.33 | 1.30 | 1.35 | 1.55 |
| Elongation at break (%) | 19 | 98 | 503 | 548 |
| Unwinding coefficient | 1.00 | 1.00 | 1.00 | 1.00~2.13 |
| Axial unwindability | Δ~X | ◎ | ◎ | X |

It is understood from the above table that the elongation at break and stretch recovery are improved as the ratio of the sheath component decreases. However, when the core/sheath conjugate ration was 100/1, fluctuation of the unwinding coefficient was big and the axial unwinding was not performed. In this instance, exposures of the core component due to breakages of the sheath component were recognized by a careful observation. Contrarily, when this conjugate ratio is ½, the physical properties were so poor that yarn breakages occurred during axial unwinding.

EXAMPLE 7

Then, the filament yarns of Example 5-2 and Comparative Example 5-2 were loaded with a weight of 1 mg/d and heat-treated with hot water at 100° C. for 30 minutes, followed by air drying. Physical properties of these treated yarns are shown in Table 8.

TABLE 8

| Item | Yarn of Example 5-2 | | Yarn of Comparative Example 5-1 | |
|---|---|---|---|---|
| | Before treatment | After treatment | Before treatment | After treatment |
| Tensile strength (g/d) | 1.13 | 1.52 | 1.59 | 1.58 |
| Elongation at break (%) | 153 | 556 | 552 | 559 |
| Recoverability (%) | 20.2 | 90.5 | 88.6 | 89.2 |

In Table 8, the stretch recovery is found by the following equation, when a 100% stretch of a yarn at room temperature was repeated twice:

$$\text{Stretch recovery (\%)} = \frac{\text{Contractile force at 50\% stretch in the 2nd stretch}}{\text{Tensile force at 50\% stretch in the 2nd stretch}} \times 100$$

The larger the above value, the more excellent the stretch recovery.

From Table 8, it is understood that the yarn according to the present invention develops stretch recovery and elongation through a hot water treatment.

Further, with the yarn of Example 5-2, a hose was knit on a single feeder knitting machine. In this case, no difficulty in operability was encountered. Alternatively, the polyurethane single component yarn of Comparative Example 5-2 could not be knit unless a special oil was applied. Then, the above hose was soaked in hot water at 100° C. for 30 minutes. The results are shown in Table 9.

TABLE 9

| Item | Hose of Example 5-2 | Hose of Comparative Example 5-2 |
|---|---|---|
| Stretch recovery in course direction after soaking | 65% | 67% |

Before soaking, the hose of this example was little stretched in contrast with that that of the comparative example had a stretch recovery of 65%.

EXAMPLE 8

The composite filament yarns comprising a crosslinked polyurethane core component (Example 5-2) shown in Example 5 was cold-drawn at a draw ratio of 2 times. In the same manner as warping of nylon yarns, these yarns were warped by drawing out from bobbins in the axial direction thereof. Alternatively, the polyurethane elastic yarns of Comparative Example 5-2 were used after rewinding and, however, in warping, these yarns could not be warped due to many yarn breakages, unless a positive yarn delivery device was used.

The yarns of Example 5-2 on a warper's beam were used as a back warp and a 50 d/12 fil nylon yarns were used as a front yarn. Then, a half tricot of 28 gauges was knit with compound needles at a speed of 1,300 r.p.m. As the result, the operability was excellent. The resulting gray fabric was scoured at 90° C. for 5 minutes and heat-set at 190° C. Then, the resulting fabric was dyed in navy blue. The dyed fabric was free from warp streaks as well as tiny defects, and was enough adaptable for application in swimsuits. It is noted that in the composite filament back warps, the sheath component had completely been dissolved away. A swimsuit made up with this fabric had a sufficient stretch recovery.

EXAMPLE 9

Replacing the thermoplastic polyurethane by a polyether-based polyurethane (the trademark, P2060: having a hardness of 86, manufactured by Dainichiseika Color & Chemicals Mfg. Co., Ltd.) and the sheath component by the following alkali-soluble polyester in Example 5, conjugate-spinning was conducted in the same manner.

Alkali-soluble polyester

Using 70 mol. % of dimethyl terephthalate, 30 mol. % of isophthalic acid, 5 mol. % of 5-sodium-sulfoisophthalic acid and 100 mol. % of ethylene glycol, a polyester was synthesized and pelletized by a usual process.

This polyester had an intrinsic viscosity of 0.52.

The results are shown in Table 10.

TABLE 10

| Item | Example 9-1 | Example 9-2 |
|---|---|---|
| Sheath component | Alkali-soluble polyester | Alkali-soluble polyester |
| Core component | Crosslinked polyurethane | Crosslinked polyurethane |
| Core/sheath conjugate ratio | 10/1 | 30/1 |
| Tensile strength (g/d) | 1.08 | 1.19 |
| Elongation at break (%) | 298 | 415 |
| Unwinding coefficient | 1.00 | 1.00 |

TABLE 10-continued

| Item | Example 9-1 | Example 9-2 |
|---|---|---|
| Axial unwindability | ◎ | ◎ |

It is understood from Table 10 that the elasticity of the composite filament yarns increases with increasing core/sheath conjugate ratio and that the yarns of the present invention has a very good unwindability, particularly, axial unwindability.

The filament yarn of Example 9-1, when it was subjected to an alkali treatment with a boiling, 1% conc. sodium hydroxide aqueous solution for 20 minutes, developed high elasticity and stretch recovery. This yarn was able to be blended with polyester fibers.

We claim:

1. A elastic composite filament characterized by a unitary filament wherein a crosslinked polyurethane having mainly an allophanate crosslinkage, with a Shore A hardness of 75–98, and a polyester readily soluble in water or an aqueous alkali solution are bonded together at a polyurethane/polyester conjugate ratio (cross-sectional area ratio) ranging from 1/1 to 90/1, extending uniformly along the length of the filament, said polyester being exposed on the surface of the filament and said polyurethane alone having a tensile strength of 1.0–5.5 g/d, an elongation at break of 350–1,200% and an excellent elastic recoverability.

2. The composite filament according to claim 1, which is a core and sheath type composite filament composed of said polyurethane as the core component and said polyester as the sheath component.

3. The composite filament according to claim 1, wherein the allophanate crosslinked structure has a crosslink density of at least 6 μmol/g.

4. The composite filament according to claim 1, wherein the allophanate crosslinked structure has a crosslink density of at least 10 μmol/g.

5. The composite filament according to claim 1, wherein said polyurethane/polyester conjugate ratio is in the range of 1/1 to 50/1.

6. The composite filament according to claim 1, wherein said polyurethane/polyester conjugate ratio is in the range of 1/1 to 5/1, and said tensile strength is in the range of 1.8 to 5.5 g/d.

7. The composite filament according to claim 1, wherein said tensile strength is in the range of 2.5 to 4.5 g/d.

8. The composite filament according to claim 1, wherein said elongation at break is 400 to 800%.

9. The composite filament according to claim 1, wherein the polyester readily soluble in water is formed from, as acid ingredients, 5–20 mol. % of an aromatic dicarboxylic acid and/or its ester-formable derivative (A ingredient), at least 55 mol. % of an aromatic dicarboxylic acid and/or its ester-formable derivative other than the A ingredient (B ingredient), an alicyclic dicarboxylic acid and/or its ester-formable derivative (C ingredient) and an aliphatic dicarboxylic acid and/or its ester-formable derivative (D ingredient) and, as a glycol ingredient, at least 50 mol. % of ethylene glycol, said C ingredient and D ingredient satisfying the following relation:

$$0\ mol.\ \% \leqq C+4D \leqq 40\ mol$$

wherein C and D represent mol fractions of the C ingredient and D ingredient, respectively, in the total acid ingredient.

10. The composite filament according to claim 9, wherein said polyester readily soluble in water has a glass transition temperature of 35° to 80° C.

11. The composite filament according to claim 1, wherein said polyester readily soluble in water is a copolyester formed from terephthalic acid, isophthalic acid and a dicarboxylic acid having a sulfonate group as acid ingredients, and ethylene glycol as a diol ingredient.

* * * * *